US009067102B2

(12) United States Patent
Poppinga

(10) Patent No.: US 9,067,102 B2
(45) Date of Patent: Jun. 30, 2015

(54) WEIGHT TRAINING DEVICE

(71) Applicant: Brady Paul Poppinga, Agoura Hills, CA (US)

(72) Inventor: Brady Paul Poppinga, Agoura Hills, CA (US)

( * ) Notice: Subject to any disclaimer, the term of this patent is extended or adjusted under 35 U.S.C. 154(b) by 13 days.

(21) Appl. No.: 14/197,527

(22) Filed: Mar. 5, 2014

(65) Prior Publication Data

US 2014/0256517 A1 Sep. 11, 2014

Related U.S. Application Data

(60) Provisional application No. 61/773,989, filed on Mar. 7, 2013.

(51) Int. Cl.

| | |
|---|---|
| ***A63B 21/00*** | (2006.01) |
| ***A63B 21/06*** | (2006.01) |
| ***A63B 21/078*** | (2006.01) |
| *A63B 21/072* | (2006.01) |
| *A63B 21/062* | (2006.01) |
| *A63B 23/04* | (2006.01) |

(52) U.S. Cl.

CPC ..... *A63B 21/078* (2013.01); *A63B 21/0724* (2013.01); *A63B 21/062* (2013.01); *A63B 2023/0411* (2013.01); *A63B 2021/0783* (2013.01); *A63B 2021/0786* (2013.01)

(58) Field of Classification Search

CPC ..... A63B 2021/0614; A63B 21/0615; A63B 2023/0411; A63B 2021/0616; A63B 21/062; A63B 21/0626; A63B 21/072; A63B 21/0724; A63B 21/078; A63B 2021/0783; A63B 2021/0786

USPC ..... 482/92–94, 98–104

See application file for complete search history.

(56) References Cited

U.S. PATENT DOCUMENTS

| | | | | |
|---|---|---|---|---|
| 3,612,523 | A * | 10/1971 | Glynn | 482/98 |
| 4,795,149 | A * | 1/1989 | Pearson | 482/98 |
| 4,934,693 | A * | 6/1990 | Santoro | 482/98 |
| 5,050,868 | A * | 9/1991 | Pearson | 482/94 |
| 5,184,992 | A * | 2/1993 | Banks | 482/104 |
| 5,215,510 | A * | 6/1993 | Baran | 482/104 |
| 5,669,859 | A * | 9/1997 | Liggett et al. | 482/94 |
| 5,738,615 | A * | 4/1998 | McCollum et al. | 482/108 |
| 7,131,937 | B2 * | 11/2006 | Skilken et al. | 482/93 |
| 7,549,950 | B1 * | 6/2009 | Lundquist et al. | 482/101 |
| 8,047,972 | B1 * | 11/2011 | Dean et al. | 482/104 |
| 8,500,608 | B1 * | 8/2013 | Bonomi | 482/101 |
| 2007/0203002 | A1 * | 8/2007 | Webber | 482/104 |
| 2014/0200117 | A1 * | 7/2014 | Grider | 482/104 |

FOREIGN PATENT DOCUMENTS

WO WO 2005030341 A1 * 4/2005 ..... A63B 21/078

* cited by examiner

*Primary Examiner* — Oren Ginsberg
*Assistant Examiner* — Joshua Lee

(57) ABSTRACT

An improved weight training device is configured to allow horizontal, vertical and rotational movement while ensuring safety. The improved weight training device includes a barbell that is immediately adjacent to two swivel bearing assemblies. The barbell is configured to slide through the two swivel bearing assemblies. A horizontal guide bar is immediately adjacent to each swivel bearing assembly. Each swivel bearing assembly is configured to slide along its horizontal guide bar. At least four vertical guide assemblies are in the improved weight training device. A vertical guide assembly is mechanically coupled to each end of each horizontal guide bar. Each vertical guide assembly is configured to slide vertically along its vertical guide bar. There are at least two brakes. Each brake is mechanically coupled to the barbell and further mechanically coupled to two of the vertical guide assemblies.

4 Claims, 5 Drawing Sheets

WEIGHT TRAINING DEVICE

RELATED APPLICATION

This application claims priority to provisional patent application U.S. Ser. No. 61/773,989 filed on Mar. 7, 2013, the entire contents of which is herein incorporated by reference.

BACKGROUND

The embodiments herein relate generally to devices used in exercise, and particularly in weight training.

Prior to the disclosed invention there was a substantial risk of injury using free weights due to the possibility that errant movement of either the user or the equipment would cause an injury. Prior art solutions to the problem have limitations either from a range of motion stand point, meaning they only allow the user to move the bar up and down, front to back or side to side. Also, the user is limited in the exercises one can perform like the inability to do Olympic lifts. Lastly, the area that one must dedicate to performing Olympic lifts is generally occupied by a weight rack and a platform where the Olympic lifts are done, which take up a lot of space. Embodiments of the present invention solve all of these problems.

SUMMARY

An improved weight training device is configured to allow horizontal, vertical and rotational movement while ensuring safety. The improved weight training device includes a barbell that is immediately adjacent to two swivel bearing assemblies. The barbell is configured to slide through the two swivel bearing assemblies. A horizontal guide bar is immediately adjacent to each swivel bearing assembly. Each swivel bearing assembly is configured to slide along its horizontal guide bar. At least four vertical guide assemblies are in the improved weight training device. A vertical guide assembly is mechanically coupled to each end of each horizontal guide bar. Each vertical guide assembly is configured to slide vertically along its vertical guide bar. There are at least two brakes. Each brake is mechanically coupled to the barbell and further mechanically coupled to two of the vertical guide assemblies. The barbell is configured to allow the horizontal, the vertical and the rotational movement and further configured to stop upon release of the at least two brakes in order to permit Olympic lifting while ensuring safety.

In some embodiments, each swivel bearing assembly further can include a counterweight with a D-Ring connected through an aperture in a barbell guide bushing. The barbell guide bushing is configured to accommodate the barbell. A horizontal guide bushing is mechanically coupled to the barbell guide bushing with a swivel bearing. The horizontal guide bushing is configured to accommodate the horizontal guide bar.

In some embodiments, each vertical guide assembly further can include a vertical guide chassis that is mechanically coupled to a vertical guide bearing. The vertical guide bearing is configured to accommodate the vertical guide bar. A pop pin which includes a D-Ring surrounding the vertical guide bar is located within the vertical guide chassis.

In some embodiments, an enclosure can be immediately adjacent to each vertical guide bar. The enclosure further comprising eleven members configured to form a hollow parallelepiped with an open front. A plurality of brake plates can be mechanically coupled to the enclosure. Each brake plate is immediately adjacent to at least one vertical guide assembly. Each pop pin is configured to fit through a brake plate hole in a nearest brake plate in order to stop any movement of the vertical guide assembly.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
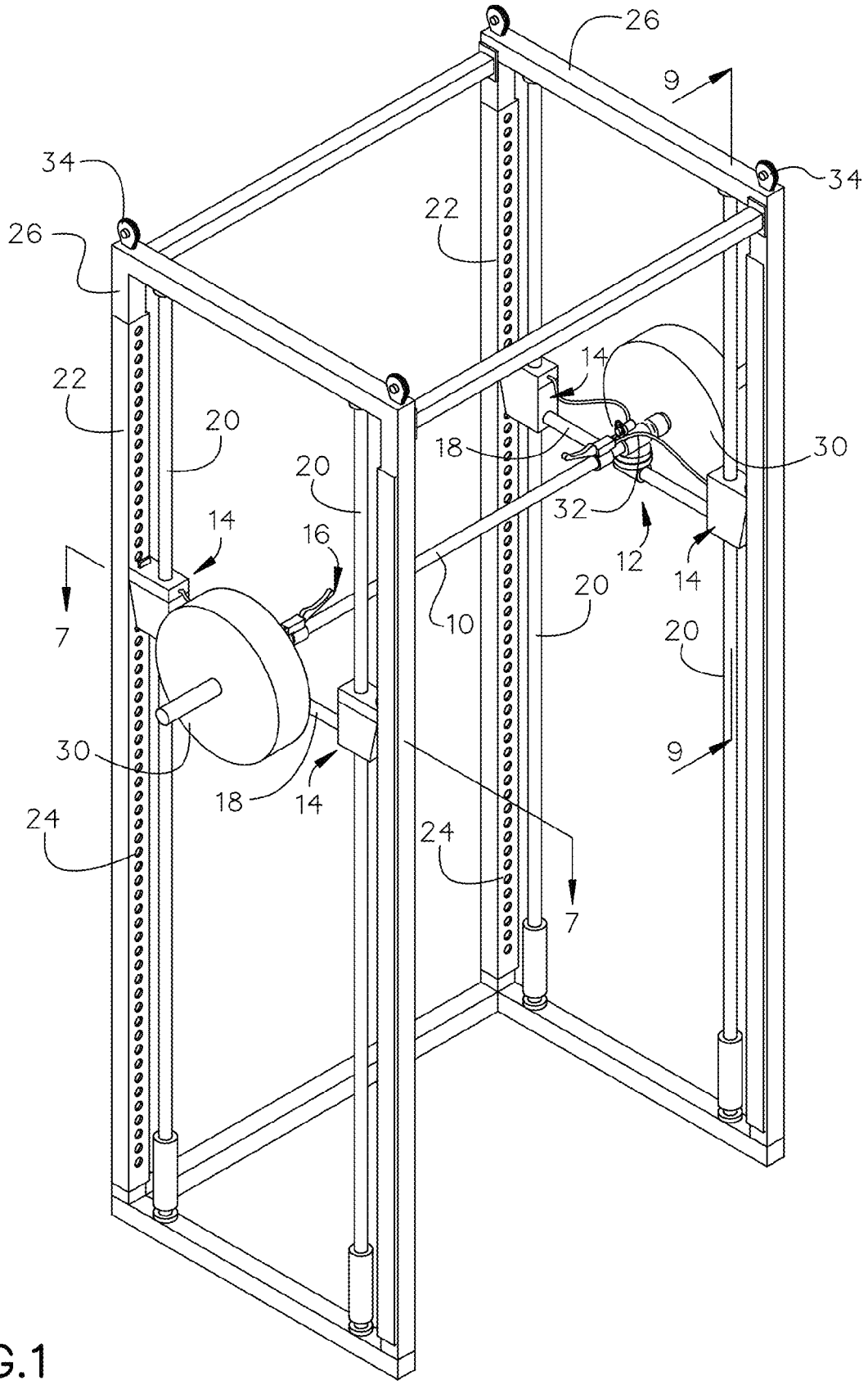
FIG. 1 is a perspective view of an embodiment of the invention.

By way of example, and referring to FIG. 1, one embodiment of the improved weight training device comprises barbell 10. Barbell 10 is immediately adjacent to first swivel bearing assembly 12 and second swivel bearing assembly 12. Barbell 10 is further connected to first brake 16 and second brake 16. First swivel bearing assembly 12 is immediately adjacent to first horizontal guide bar 18. Likewise, second swivel bearing assembly 12 is immediately adjacent to second horizontal guide bar 18. First horizontal guide bar 18 is further mechanically coupled to first vertical guide assembly 14 and third vertical guide assembly 14. Additionally, first vertical guide assembly 14 is connected to first brake 16 with brake line 32. Likewise, third vertical guide assembly 14 is connected to first brake 16 with brake line 32.

First vertical guide assembly 14 is immediately adjacent to and configured to travel along first vertical guide bar 20. While first vertical guide assembly 14 travels along first vertical guide bar 20, first vertical guide assembly 14 is immediately adjacent to first brake plate 22, which is perforated with a plurality of first brake plate holes 24.

Likewise, third vertical guide assembly 14 is immediately adjacent to and configured to travel along third vertical guide bar 20. While third vertical guide assembly 14 travels along third vertical guide bar 20, third vertical guide assembly 14 is immediately adjacent to third brake plate 22, which is perforated with a plurality of third brake plate holes 24.

Similarly, second horizontal guide bar 18 is further mechanically coupled to second vertical guide assembly 14 and fourth vertical guide assembly 14. Second vertical guide assembly 14 is connected to second brake 16 with brake line 32. Likewise, fourth vertical guide assembly 14 is connected to second brake 16 with brake line 32.

Second vertical guide assembly 14 is immediately adjacent to and configured to travel along second vertical guide bar 20. While second vertical guide assembly 14 travels along second vertical guide bar 20, second vertical guide assembly 14 is immediately adjacent to second brake plate 22, which is perforated with a plurality of second brake plate holes 24.

Additionally, fourth vertical guide assembly 14 is immediately adjacent to and configured to travel along fourth vertical guide bar 20. While fourth vertical guide assembly 14 travels along fourth vertical guide bar 20, fourth vertical guide assembly 14 is immediately adjacent to fourth brake plate 22, which is perforated with a plurality of fourth brake plate holes 24.

Second brake plate 22, first brake plate 22, fourth brake plate 22 and third brake plate 22 are mechanically coupled to enclosure 26, which contains eleven members connected to form a hollow parallelepiped with an open front. In some embodiments, a plurality of pulleys 34 can be used to raise and lower enclosure 26 with lines as desired by a user making the enclosure portable and space saving. In some embodiments weights 30 are on barbell 10, but that is not required for operation. Within the enclosed there are at least four vertical guide assemblies (indicated above).

Turning to FIG. 2, FIG. 3, FIG. 4, FIG. 5 and FIG. 6, each swivel bearing assembly 12 comprises counterweight with D-Ring 44 connected through an aperture in barbell guide bushing 46. Barbell guide bushing 46 is configured to accommodate barbell 10. Barbell guide bushing 46 is mechanically coupled to horizontal guide bushing 48 with swivel bearing 50. Horizontal guide bushing 48 is configured to accommodate horizontal guide bar 18.

Figure 8:
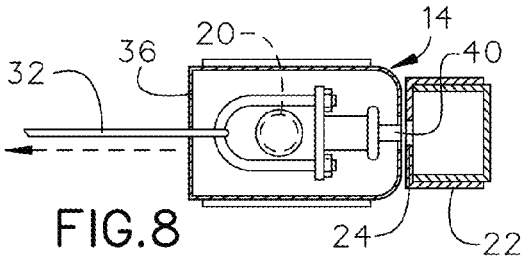
FIG. 8 is section detail view of an embodiment of the invention demonstrated with the pop pin disengaged.
Figure 9:
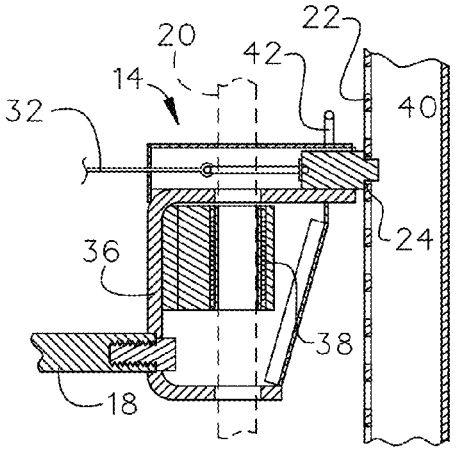
FIG. 9 is section detail view of an embodiment of the invention along line 9-9 in FIG. 1 demonstrated with the pop pin engaged.
Figure 10:
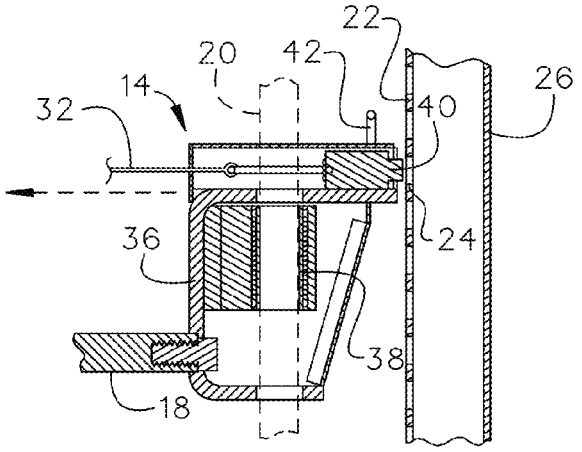
FIG. 10 is section detail view of an embodiment of the invention demonstrated with the pop pin disengaged.

Each vertical guide assembly 14 is connected to an end of the barbell. Each vertical guide assembly 14 comprises vertical guide chassis 36 mechanically coupled to vertical guide bearing 38. Vertical guide bearing 38 is configured to accommodate vertical guide bar 20. Brake line 32 is mechanically coupled to pop pin 40 which comprises a D-Ring surrounding vertical guide bar 20. When brake 16 is squeezed brake line 32 retracts (as shown in FIG. 8 and FIG. 10) which pulls pop pin 40 from through brake plate hole 24 and from brake plate 22.

Figure 2:
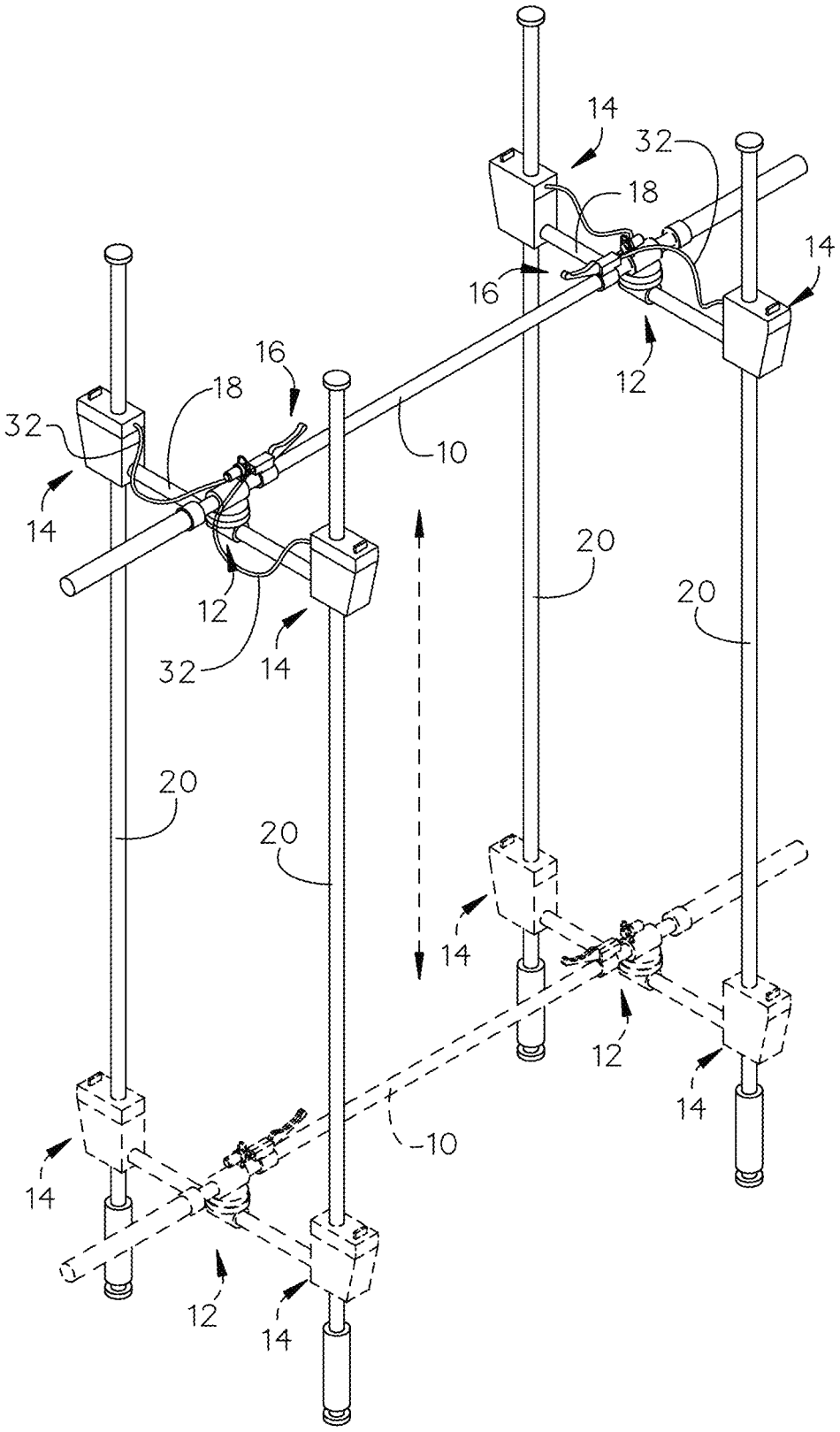
FIG. 2 is a perspective view of an embodiment of the invention intentionally illustrated without the frame or the brake mechanism cable for illustrative clarity and demonstrating vertical translation of the barbell and associated components.
Figure 3:
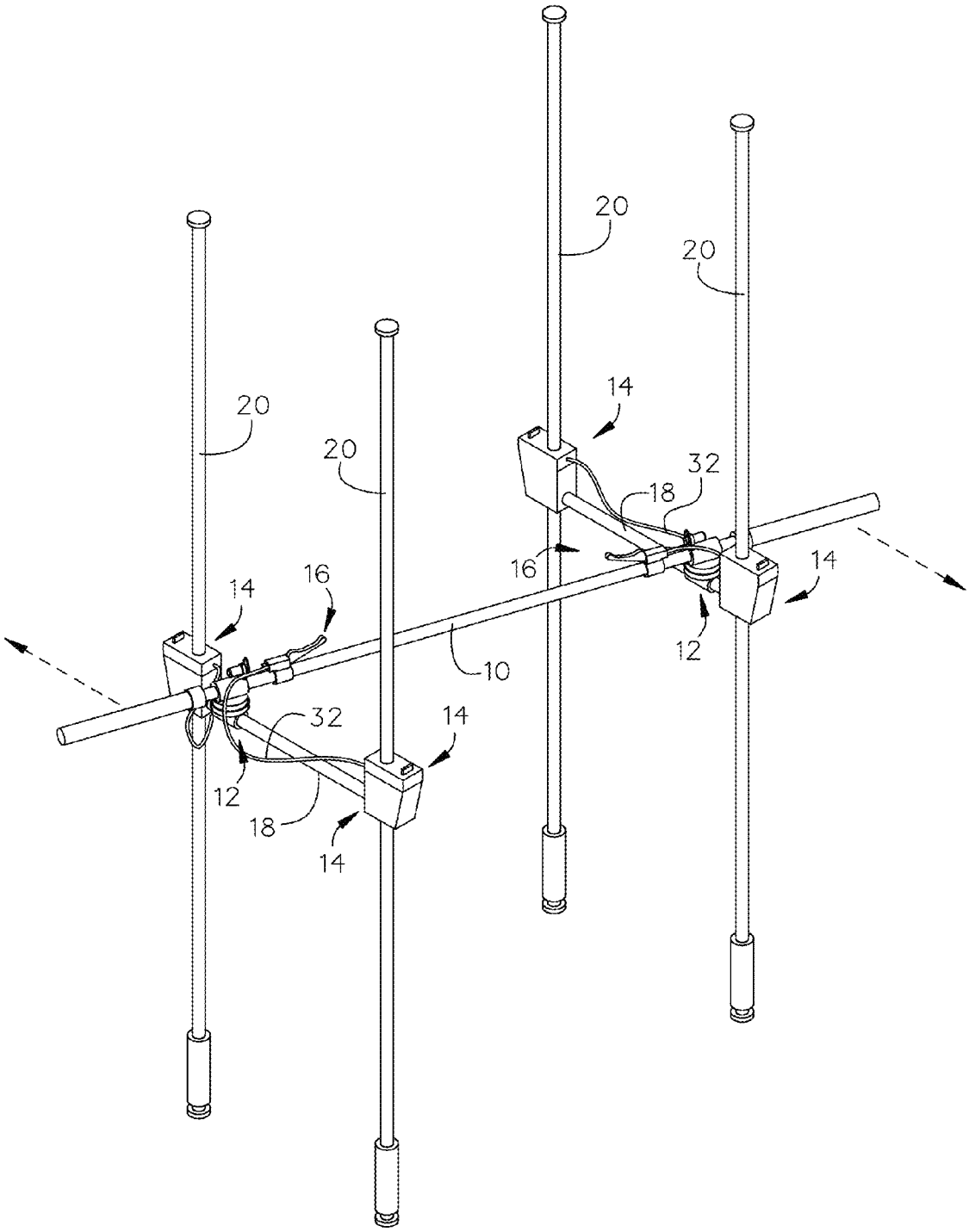
FIG. 3 is a detail perspective view of an embodiment of the invention demonstrating vertical translation of the vertical guide bar linear bearing and associated components along the vertical guide bar.
Figure 4:
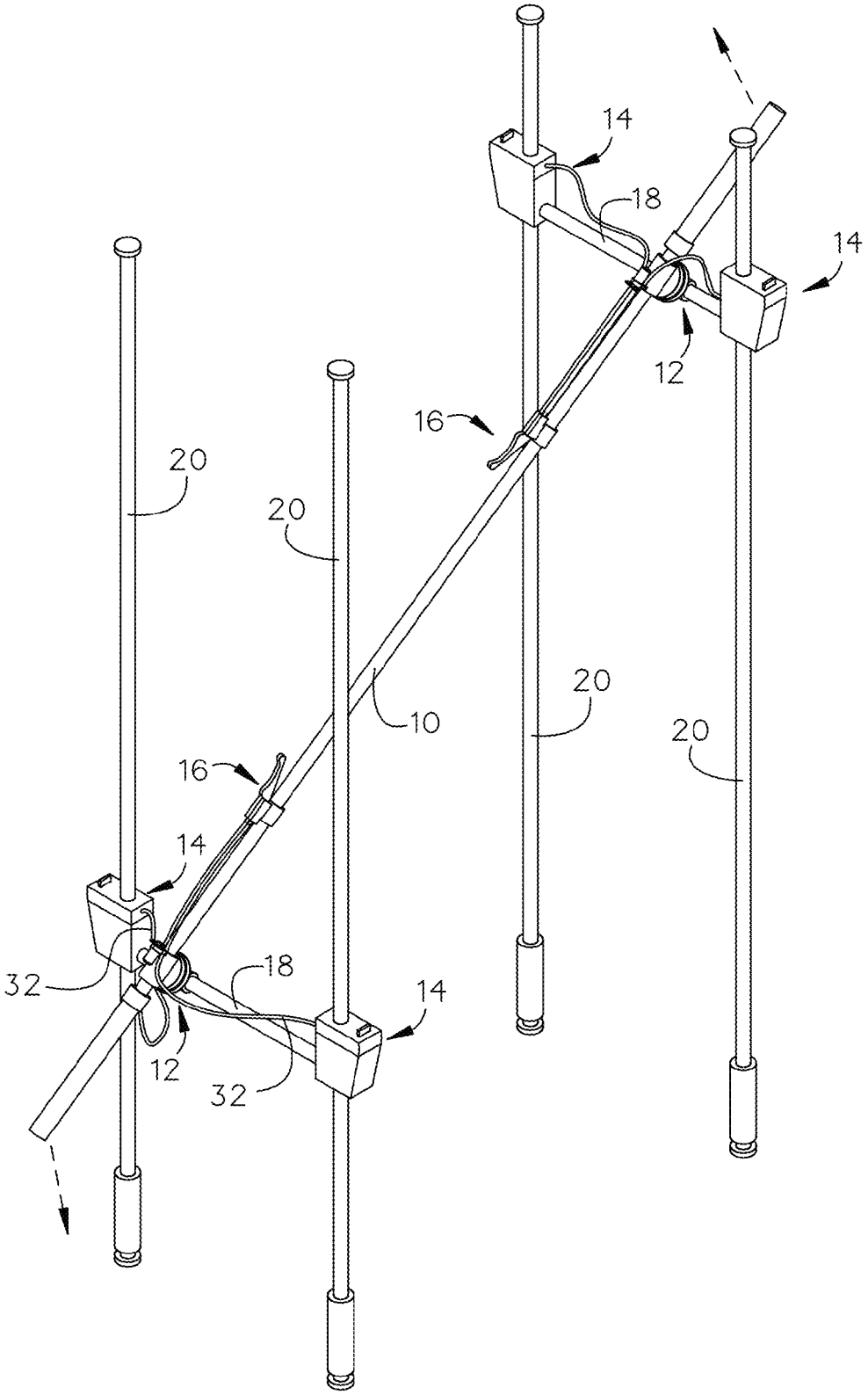
FIG. 4 is a perspective view of an embodiment of the invention intentionally illustrated without the frame or the brake mechanism cable for illustrative clarity and demonstrating rotational translation of the barbell and associated components.
Figure 5:
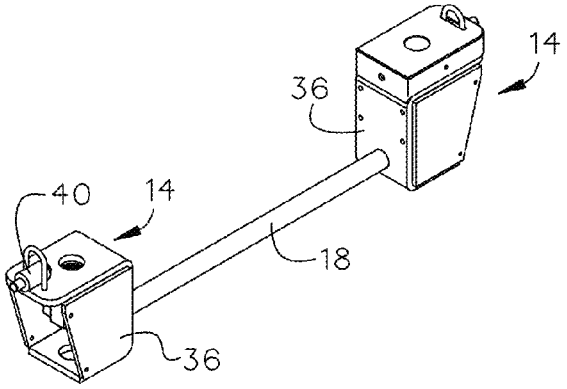
FIG. 5 is a detail perspective view of an embodiment of the invention demonstrating the horizontal guide bar and associated components.
Figure 6:
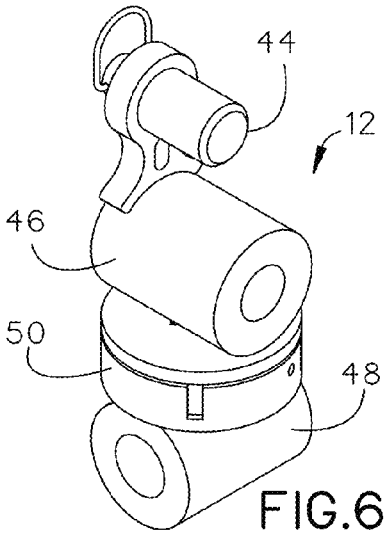
FIG. 6 is a perspective view of an embodiment of the swivel bearing assembly.
Figure 7:
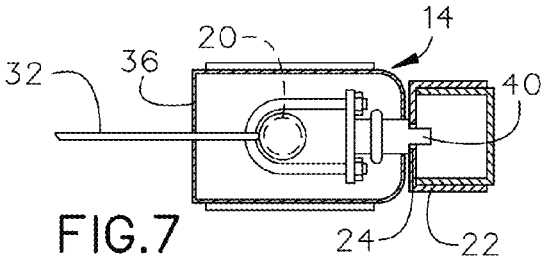
FIG. 7 is section detail view of an embodiment of the invention along line 7-7 in FIG. 1 demonstrated with the pop pin engaged.

When brakes 16 are squeezed, that is released, then vertical guide assemblies 14 can slide along their respective vertical guide bars 18 as shown in FIG. 2. Swivel bearing 50 is configured to permit swivel bearing assembly 12 to slide along horizontal guide bar 14 as shown in FIG. 3. Likewise, due to vertical guide bearing 38, one set of vertical guide assemblies 14 can be lifted above or below another set of vertical guide assemblies 14 as shown in FIG. 4.

Thus, barbell 10 can move horizontally, vertically and rotationally. This permits a full range of movement that is necessary for Olympic lifts. Additionally, if a user fails in a lift the user can simply release at least two brakes 16 and pop pins 40 will enter brake plate holes 24 in brake plates 22 causing barbell 10 to immediately stop moving and prevent an injury.

Additionally, a user can complete lifts known as "true explosive" lifts such as jump squats, snatch throws, push press throws, bench press throws, and so on. In these true explosive lifts, barbell 10 is released by the user at the top of the lift. It is safer than ever to do those types of lifts because, as soon as the user lets go of barbell 10 and brakes 16, brakes 16 will activate and barbell 10 will come to a complete stop. Thus, saving the user from having to take on the excessive and potentially harmful fall of the load of weight 30 and barbell 10.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An improved weight training device, configured to allow horizontal, vertical and rotational movement while ensuring safety; the improved weight training device comprising:

a barbell, immediately adjacent to two swivel bearing assemblies; wherein the barbell is configured to slide through the two swivel bearing assemblies;

a horizontal guide bar, immediately adjacent to each swivel bearing assembly; wherein each swivel bearing assembly is configured to slide along its horizontal guide bar;

at least four vertical guide assemblies; wherein a vertical guide assembly is mechanically coupled to each end of each horizontal guide bar; wherein each vertical guide assembly is configured to slide vertically along a vertical guide bar;

at least two brakes; wherein each brake is mechanically coupled to the barbell and is further mechanically coupled to two of the vertical guide assemblies;

wherein the barbell is configured for horizontal, vertical and rotational movement and is further configured to stop upon release of the at least two brakes in order to permit Olympic lifting while ensuring safety.

2. The improved weight training device of claim 1, wherein each swivel bearing assembly further comprises:

a counterweight with a D-Ring connected through an aperture in a barbell guide bushing; wherein the barbell guide bushing is configured to accommodate the barbell; and a horizontal guide bushing mechanically coupled to the barbell guide bushing with a swivel bearing; wherein the horizontal guide bushing is configured to accommodate the horizontal guide bar.

3. The improved weight training device of claim 1, wherein each vertical guide assembly further comprises:

a vertical guide chassis, mechanically coupled to a vertical guide bearing; wherein the vertical guide bearing is configured to accommodate the vertical guide bar; and a pop pin, further comprising a D-Ring surrounding the vertical guide bar within the vertical guide chassis.

4. The improved weight training device of claim 3, further comprising an enclosure immediately adjacent to each vertical guide bar, the enclosure further comprising eleven members configured to form a hollow parallelepiped with an open front;

a plurality of brake plates mechanically coupled to the enclosure; wherein each brake plate is immediately adjacent to at least one vertical guide assembly;

wherein each pop pin is configured to fit through a brake plate hole in a nearest brake plate in order to stop any movement of the vertical guide assembly.

* * * * *